United States Patent [19]

Raasch

[11] Patent Number: 4,697,310

[45] **Date of Patent: * Oct. 6, 1987**

[54] DEVICE FOR EXCHANGING EMPTY CANS WITH CANS FILLED WITH SLIVER

[75] Inventor: Hans Raasch, Moenchengladbach, Fed. Rep. of Germany

[73] Assignee: W. Schlafhorst & Co., Moenchengladbach, Fed. Rep. of Germany

[ * ] Notice: The portion of the term of this patent subsequent to Sep. 22, 2004 has been disclaimed.

[21] Appl. No.: 829,536

[22] Filed: Feb. 14, 1986

[30] Foreign Application Priority Data

Feb. 16, 1985 [DE] Fed. Rep. of Germany ..... 3505495

[51] Int. Cl.[4] ..... B65H 67/02

[52] U.S. Cl. ..... 19/159 A

[58] Field of Search ..... 19/159 R, 159 A

[56] References Cited

U.S. PATENT DOCUMENTS 4,109,357 8/1978 Burow et al. ..... 19/159 A 4,477,945 10/1984 Vignon et al. ..... 19/159 A

*Primary Examiner*—Louis K. Rimrodt

*Attorney, Agent, or Firm*—Herbert L. Lerner; Laurence A. Greenberg

[57] ABSTRACT

A device for exchanging empty cans with cans filled with sliver at a sliver processing machine having set locations for the cans wherein a mobile transport device is automatically driven along a floorlike travel path at the machine include successively placing filled cans entrained with the transport device automatically at set locations of the machine which are unoccupied, picking up empty cans automatically with the transport device, and driving the transport device automatically back to a loading station, when the transport device is too full to pick up any more cans, so as to surrender the empty cans and pick up filled cans at the loading station preparatory to driving the transport device back to the sliver-processing machine or to another machine.

5 Claims, 4 Drawing Figures

DEVICE FOR EXCHANGING EMPTY CANS WITH CANS FILLED WITH SLIVER

The invention relates to a method and device for exchanging empty cans with cans filled with sliver at a sliver-processing machine having set locations for the cans wherein a mobile transport device is automatically driven along a floorlike travel path at the machine.

At machines for processing sliver, such as spinning machines, for example, the cans are conventionally changed manually during operation. In this regard, a respective adequately large servicing aisle or corridor is required at the machine or between mutually adjacent machines. Can transport and exchange of cans by hand are complicated and time-consuming and require considerable effort.

It is accordingly an object of the invention to provide a method and device for exchanging empty cans with cans filled with sliver wherein the exchange is simplified, automated and accelerated, taking into account that the advantages of the invention are not only applicable to new installations, but rather, also for machines which have already been in operation.

It is also an object of the invention to provide such a new device or retrofit a conventional device as well as provide such a new method or suitably revise conventional methods without any major inconvenience and cost.

With the foregoing and other objects in view, there is provided, in accordance with the invention, a method of exchanging empty cans with cans filled with sliver at a sliver processing machine having set locations for the cans wherein a mobile transport device is automatically driven along a floorlike travel path at the machine, which comprises successively placing filled cans entrained with the transport device automatically at set locations of the machine which are unoccupied, picking up empty cans automatically with the transport device, and driving the transport device automatically back to a loading station, when the transport device is too full to pick up any more cans, so as to surrender the empty cans and pick up filled cans at the loading station preparatory to driving the transport device back to the sliver-processing machine or to another machine.

In accordance with another aspect of the invention, there is provided a device for exchanging empty cans with cans filled with sliver at a sliver-processing machine having set locations for the cans comprising a mobile transport device automatically drivable along a floorlike travel path at the machine, the mobile transport device having first means for recognizing the presence of an empty can on one of the set locations of the machine, and a loading device for empty cans entrained therewith and cooperatively associated with the first recognizing device; and having second means for recognizing absence of a can at set locations which are unoccupied, and an unloading device for filled cans entrained with the transport device and cooperatively associated with the second recognizing device.

When exchanging cans, it is necessary only to place the empty cans at set locations so that the mobile transport device recognizes each individual can and then automatically meets the individual requirements or conditions for loading the cans and finally for transporting them away. Unoccupied set locations for the cans are recognized or detected by the transport device automatically which is then able to place a filled can again at each individual unoccupied set location.

The loading device may, for example, also be formed of a conventional manual device provided with can-gripping members.

In accordance with another feature of the invention, the transport device is formed with a common set surface for both filled and empty cans. With a common set surface, the space which is available is better utilized than with separate set surfaces.

In accordance with a further feature of the invention, the common set surface is inclined from front to rear thereof in travel direction of the transport device and, even more specifically in accordance with the invention, the set surface is formed by mutually adjacent rotatably mounted rollers. This has the advantage that empty cans loaded at the front of the set surface roll or slide from front to rear either by themselves or merely by applying a relatively slight force thereto, so that they even entrain filled cans and deliver them, respectively, to a defined rear unloading position from which they then can be unloaded successively.

For this reason, in accordance with an added feature of the invention, the loading device for empty cans is arranged advantageously in the front of the set surface, as viewed in travel direction of the transport device, and the unloading device for filled cans is arranged in the rear thereof as viewed in the direction of travel.

In accordance with an additional feature of the invention and in order to prevent any disruptions due to overloading, there are provided means for permitting the loading device to load empty cans on the transport device only when the unloading device has unloaded a filled can from the transport device.

In accordance with yet another feature of the invention, the sliver-processing machine is divided into sections, and the set locations for the cans recognizable by the first and second recognizing means for the transport device are disposed at given locations of each of the sections. Provision can thus be made for the transport device to stop at these specific locations, and the device thereof for recognizing empty cans determines initially whether one or more empty cans are present at the specific location. Moreover, provision can be made for place to be kept free at specific locations so that a filled can may stop there. The transport device can then initially unload a filled can and then load an empty can. Thereafter, the transport device can, if necessary or desirable, again unload a filled can and newly load an empty can, until no empty cans are present any longer. Then, the transport device can travel farther to the next section. Due to such a procedure an high operating rate or tempo is assured.

In accordance with yet a further feature of the invention, the first and second recognizing means include at least one sensor for detecting the presence of a can on a set location, and at least another sensor for detecting the presence of a sliver filling in the can. If one of the sensors responds, the respective can is loaded, if no sensors at all are responsive, this means an unoccupied set location, and a filled can is then unloaded.

In accordance with yet an added feature of the invention, the first and second recognizing means include first sensors for detecting the presence of an empty can at a respective set location, the first sensors being operatively connected to the loading device for controlling the loading device, and second sensors for detecting absence of any can at a respective unoccupied set location, the second sensors being operatively connected to the unloading device for controlling the unloading device. For the case wherein the sliver-processing machine is divided into sections, in accordance with yet an additional feature of the invention, the transport device has at least one sensor for recognizing the sections. The signal of such a sensor can, for example, enable the transport device to stop at this section.

In accordance with another feature of the invention, the first and second recognizing means include sensors for detecting empty cans and unoccupied set locations, and include additional sensors for recognizing the sections or section boundaries of the sliver-processing machine, and drive means for the mobile transport device, the sensors being operatively connected to the drive means for controlling the drive means.

If the respective sensors, for example, recognize an empty can, the transport device travels to the vicinity of this can and then remains standing there so that the can is loaded while the transport device is stopped. If others of the sensors recognize a free or unoccupied set location, for example, the transport device remains standing adjacent this set location and the unloading device then fills this unoccupied set location with a filled can which has been entrained or carried by the transport device. In a different type of operation, a sensor recognizes a section, lets the transport device stop thereat, and enables the other sensors to become active.

The instant the situation arises wherein the load capacity has been reached, no additional cans are loaded anymore, and the transport device travels on to a loading station to deliver the empty cans thereat and to pick up filled cans.

The unloading of empty cans by the unloading device can be prevented by firmly programming the unloading device to perform so many unloading operations as the number of filled cans which are able to be carried in the space on the loading surface. The instant all of the filled cans are unloaded, the possibility is afforded for the transport device to travel back immediately by the fastest route to the loading station in order to pick up newly filled cans thereat.

Especially as a protection against accidents and in accordance with another feature of the invention, the mobile transport device has at least one sensor for detecting an obstruction located on the travel path of the transport device. This sensor serves the purpose of enabling the transport device to stop. For this purpose, it may have, for example, an operative connection with a travelling-gear motor of the drive means for the transport device.

In accordance with a further feature of the invention, there is provided a travel-path measuring device located on the mobile transport device and cooperatively connected to the travelling-gear motor and/or to the sensors and/or to the loading device and/or to the unloading device. The instant a sensor is responsive, the travel path measuring device, for example, is activated in order to bring the travelling gear itself into the correct position necessary for, respectively, loading and unloading. Depending upon the construction of the loading device and the unloading device, slight travel movements of the transport device may also be necessary yet during the loading or unloading operations, for which purpose a travel-path measuring device is likewise useful. Moreover, it may be necessary, to drive the transport device back out of the unloading position thereof in order to be able to unload a further held-back empty can. In this regard, the travel-path measuring device serves to measure beforehand the travel path required for this purpose which the transport device had, in fact, previously once covered or traversed.

In accordance with a further feature of the invention, a travel lane encircles the sliver-processing machine and is traversible by the mobile transport device. Preferably, only one travel direction is always maintained in this somewhat oval travel lane. If a plurality of the sliver-processing machines are disposed adjacent one another, the transport device can loopingly encircle these machines successively. It can thus happen that no can is either loaded or unloaded at one of the machines. In such a case, the transport device would uselessly encircle the respective machine whereas, perhaps, loading and unloading operations are urgently required at another machine.

In order to ensure effective operation of the transport device in this and similar cases, and in accordance with a concomitant feature of the invention, there is provided a counter for counting empty cans at the sliver-processing machine, the counter being operatively connected to the mobile transport device for enabling the transport device when at least as many empty cans have been counted as the number of cans filled with sliver which can be transported by the mobile transport device. If the arrangement of cans at the machine is itself performed manually, the counter can, for example, be actuated by pressing a button located at each section, the instant an empty can reaches a set location. On the other hand, empty cans reaching the set locations can also be counted automatically. What is important is that the counter always gives an exact count of the empty cans. Provision can be made, for example, that a counter correction be performed either manually or automatically, after each pass of the transport device. The counter correction can also be effected by the transport device per se.

Other features which are considered as characteristic for the invention are set forth in the appended claims.

Although the invention is illustrated and described herein as embodied in a method and device for exchanging empty cans with cans filled with sliver, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 4:
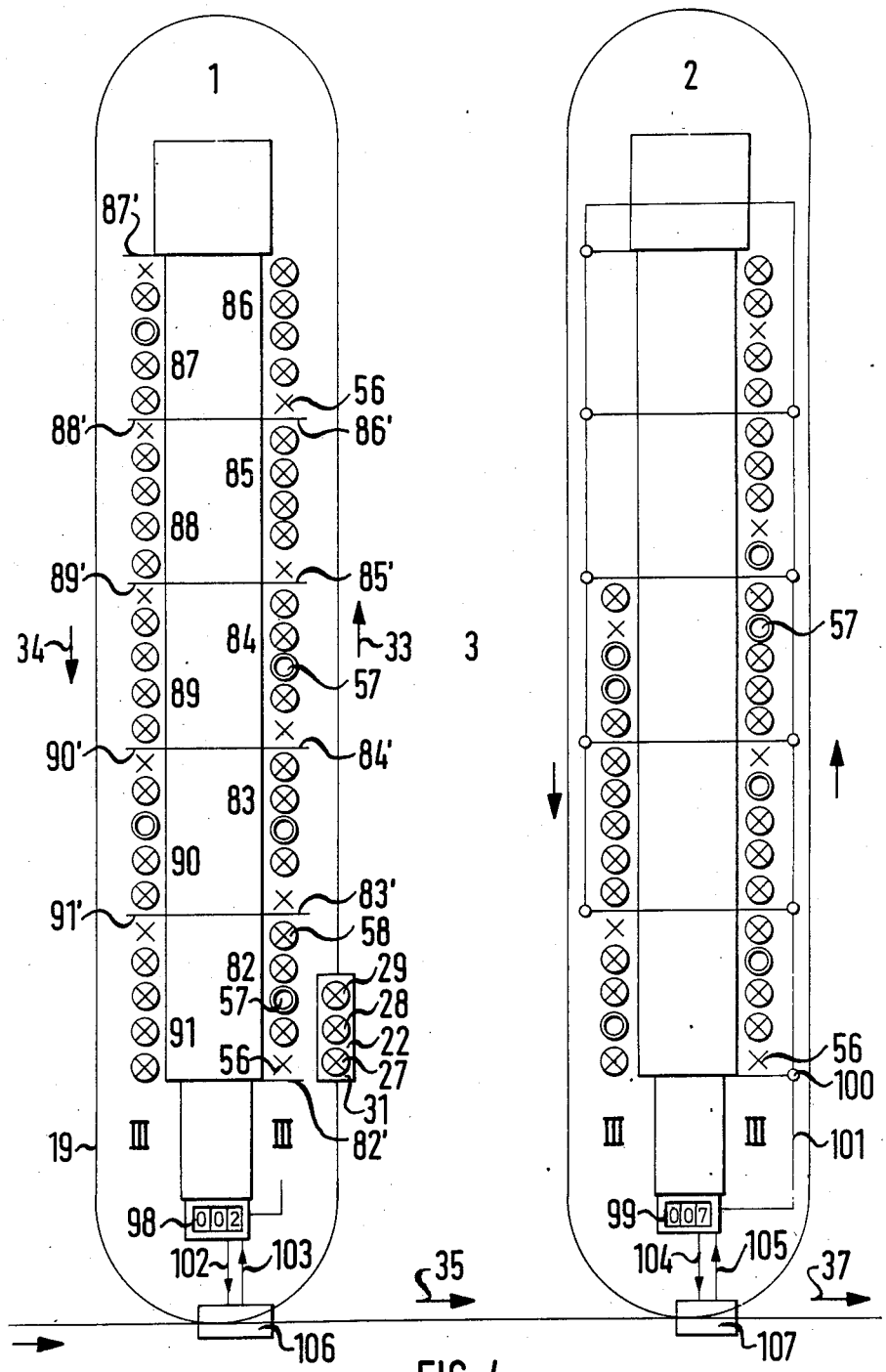
FIG. 4 is a much enlarged, highly diagrammatic top plan view of FIG. 2 showing the can exchanging device in installed position between two spinning machines.

Referring now to the drawing and first, particularly, to FIG. 4 thereof, there are shown two spinning machines 1 and 2 disposed on a level floor. A servicing passage or corridor 3 is located between the spinning machines 1 and 2.

Both spinning machines 1 and 2 have a two-sided construction and include a multiplicity of spinning stations on both sides thereof, respectively, which are described hereinafter with respect to the spinning machine 1 according to FIG. 4, by way of example.

Figure 2:
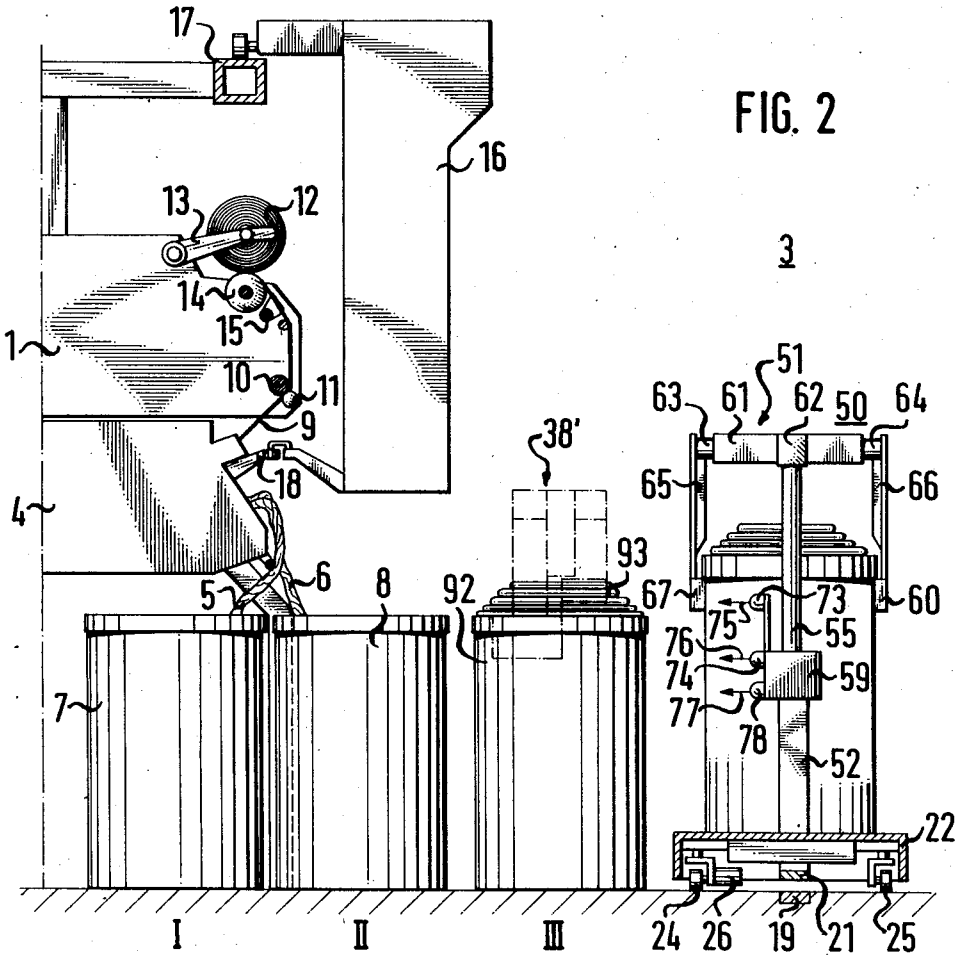
FIG. 2 is a partly diagrammatic rear elevational view of the can exchanging device of FIG. 1 in installed position adjacent a spinning machine and facing in travel direction thereof into the plane of the drawing.

As shown in FIG. 2, sliver 5 runs into a spinning box 4 from a can 7, for example. A sliver 6 runs into a spinning box of a next-following spinning station located behind the spinning box 4, the sliver 6 originating, for example, from a can 8.

In the spinning box 4, the sliver 5 is spun into a thread 9 which is continuously drawn-off by a draw-off or take-up roller pair 10, 11 and fed to a rotating crosswound coil or cheese 12. The crosswound coil 12 is pivotally mounted in a package cradle or creel 13, lies on and is driven by a rotating drum 14. A reciprocating thread guide 15 provides for the lay of the thread in crosswound layers.

A travelling piecing or joining and cleaning device 16 can travel on a rail 17 and along a support rail 18 from spinning station to spinning station and perform the joining or piecing and cleaning operations.

Under the floor, there is located a guide rail 19 formed of magnetically conductive material, the guide rail 19 acting upon two induction devices 20 and 21 so as to hold a mobile transport device 22 on course. The induction device 20 is linked to two forward rollers 23, and the induction device 21 to rear rollers 24 and 25. The roller 24 is drivable by a battery-driven motor 26.

FIG. 2 reveals that the cans 8, respectively, are disposed in three rows I, II and II. The sliver runs out of the rows I and II into the individual spinning boxes. Set locations for reserve cans are in the row III. In FIG. 4, free set locations 56 are represented by crosses, empty cans 57 by circles, and filled reserve cans 58 by circled crosses.

FIG. 4 shows that not all of the set locations 56 are occupied by cans, and that the transport device 22 is, in fact, engaged in sequentially unloading cans 27, 28 and 29 filled with sliver and placing them on free set locations. To the extent that locations become free on the set surfaces 31 thereof, the transport device 22 loads empty cans 57 consecutively until the entire set surface 31 is filled with empty cans. The transport device 22 then travels with three empty cans on a given travel strip in direction of the arrows 33, 34, 35 back to an otherwise non-illustrated loading station where it surrenders the empty cans and receives filled cans.

Figure 1:
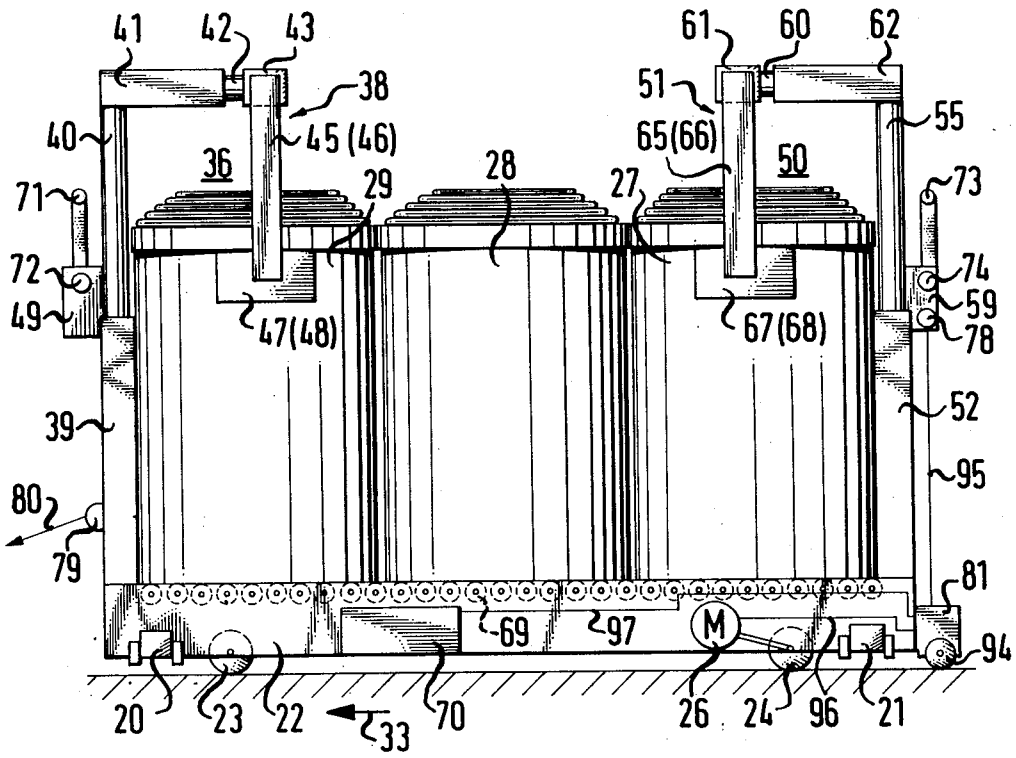
FIG. 1 is a partly diagrammatic side elevational view of a device for exchanging empty cans with cans filled with sliver in accordance with the invention.
Figure 3:
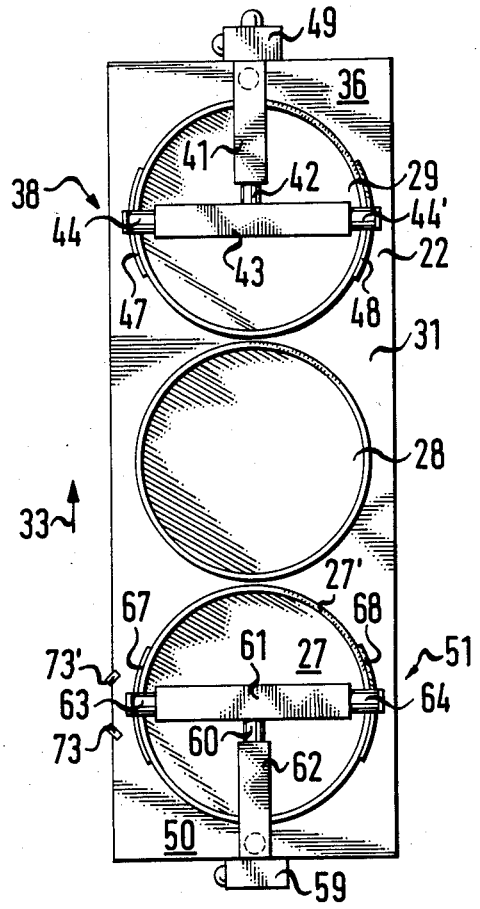
FIG. 3 is a fragmentary top plan view of FIG. 2 showing the can exchanging device.

Further details of the transport device 22 are shown in FIGS. 1 to 3.

A loading device 36 is located on the transport device 22 frontwards in the direction of travel 33. The loading device 36 is constructed as a manipulation or handling device. The loading device 36 has a can gripping device 38 and a can lifting device 39.

The can lifting device 39 is formed of an hydraulic cylinder having a rotatable piston rod 40 which carries another hydraulic cylinder 41 which has a piston rod 42 carrying an hydraulic cylinder 43. The hydraulic cylinder 43 belongs to the can gripping device 38. Both of the piston rods 44 and 44' of the hydraulic cylinder 43 carry vertically downwardly directed holders 45 and 46, respectively, at the ends of which holder shells 47 and 48, respectively, are located. A turning device 49 is provided for turning the piston rod 40 about the longitudinal axis thereof.

By subjecting the hydraulic cylinders to pressure oil and by actuating the turning device 49, the can gripping device 38 can be swung out to the position 38' thereof indicated in FIG. 2 in order to pick up an empty can. In this regard, the holder shells 47 and 48 suitably open and close for this purpose.

At the rear end of the transport device 22, there is an unloading device 50 which has a can gripping device 51 and a can lifting device 52.

The can lifting device 52 is formed of an hydraulic cylinder having a piston rod 55 which is turnable by a turning device 59, and carries another hydraulic cylinder 62 having a piston rod 60 which, in turn, carries an hydraulic cylinder 61. The hydraulic cylinder 61 belongs to the can gripping device 51. Both of the piston rods 63 and 64 of the latter hydraulic cylinder 61 carry vertically downwardly extending holders 65 and 66, respectively, at the ends of which, holder shells 67 and 68, respectively, are located.

By subjecting the hydraulic cylinders of the can lifting device 52 to pressure oil and by actuating the turning device 59, the can gripping device 51 can be swung out to the position 38' shown in phantom in FIG. 2 in order to unload a filled can. In this regard, the holder shells 67 and 68, respectively, suitably open and close in accordance with this purpose.

The set surface 31 of the transport device 22 is slightly inclined from the front towards the rear thereof and is formed by mutually adjacent, rotatably mounted rollers 69, as shown in FIG. 1. Under the roller train 69, there is located a switching device 70 which contains therein non-illustrated conventional components for ensuring the coordination of the aforementioned devices, a current supply device for the motor 26 and an hydraulic oil supply device for the hydraulic cylinders.

According to FIG. 4, the spinning machine 1 is divided on one side thereof into sections 82 to 86 and on the other side thereof into sections 87 to 91, counting in the travel direction 33 and 34, respectively, of the transport device 22.

The free set locations 56 for cans recognizable for the transport device 22 are located at a specific location in each section, namely, in travel direction, respectively, behind the section boundaries 82' to 91'. Also, the empty cans 57, recognizable for the transport device 22, are always located at a specific place in each section, namely at a location which is third from the respective section boundary.

Provision is made for the transport device 22 to stop at the aforementioned specific locations of the sections and to orient itself to the section boundaries, as is described hereinafter in even greater detail.

To recognize or detect the empty cans 57 and whether cans are located at or missing from the set locations 56, the transport device 22 is provided with several sensors in the form of reflecting light barriers. According to FIG. 1, two sensors 71 and 72 are located at the front thereof as viewed in travel direction, and two sensors 73 and 74 at the rear thereof, considered with regard to the travel direction. According to FIG. 2, a light beam 75 of the sensor 73 is directed towards a sliver 93 which may possibly project out of a can 92. A light beam 76 of the other sensor 74 is directed towards a can 92 necessarily or desirably disposed on a set location 56.

A non-illustrated light beam of the sensor 72 is directed towards the can 57 shown in FIG. 4. The likewise non-illustrated light beam of the sensor 71 is directed towards a sliver which may have been supplied to and may be projecting upwardly out of the can 57. According to FIG. 2, the light beam 77 of another sensor 78 is directed towards the section boundaries shown in FIG. 4, in this case especially towards the section boundary 82'. According to FIG. 1, the transport device 72 has another sensor 79 located in front thereof as viewed in travel direction thereof, the sensor 79 having a downwardly inclined, widely fanned-out light beam 80 directed towards obstacles or impediments which may possibly be located on the travel path.

According to FIG. 1, the transport device 22 has a travel-path measuring device 81 with a travel-path measuring roller 94 lying on the floor and driven by friction during travel. In the interior of the travel-path measuring device 81, there is a conventional meter or register for measuring the length of travel driven by the travel-path measuring roller 94. An operative connection 95 extends from the sensor 78 to the travel-path measuring device 81 and, from the latter, an operative connection 96 extends to the travelling-gear motor 26. Another operative connection extends from the travel-path measuring device 81 to the switching device 70.

The instant the sensor 78 determines or detects that a section boundary has been reached, a pulse is transmitted via the operative connection 95 to the travel-path measuring device 81 which, in turn, after a predetermined travel distance has been traversed, transmits a pulse via the operative connection 96 to the travelling-gear motor 26 to enable it to stop. The exact position of the transport device 22 in front of the section at which the can exchange is to be performed, is reached so that the travel-path measuring device 81 can transmit correcting pulses via the operative connection 96 in order thereby to enable the travelling-gear motor 26, if necessary or desirable, to run forwardly or in reverse in crawling or creep speed, until the measured travel distance corresponds to a nominal value. Thereafter, a pulse is transmitted from the travel-path measuring device 81 via the operative connection 97 to the switching device 70 which, thereupon, activates the sensors 71 to 74 which, in turn, issue the required acknowledgements to the switching device 70 so as to enable, with the aid of the switching device 70, the activities of the loading device 36 and the unloading device 50, respectively, which are necessary to effect exchange of the cans.

According to FIG. 4, the transport device 22 is drivable on a traffic lane symbolized by the guide rail 19 which encircles the respective spinning machines 1 and 2.

As shown in FIG. 4, the spinning machine 1, as well as the spinning machine 2, has a respective counter 98, 99. The counters 98 and 99 count the empty cans 57 arranged in the respective spinning machine 1, 2 which stand ready to be picked up or removed. In this regard, for example, in the spinning machine 2, a counter or register key is provided at each section boundary. Altogether, ten counter keys are provided which are connected via a line 101 to the respective counters 99 and 98.

What is then prescribed is that whenever an empty can stands ready to be picked up or removed, one the counter keys 100 is to be pressed, whereby the respective counter 98, 99 is advanced or adds one unit.

Operative connections 102 and 103 are provided between the counter 98 and a conventional track switch point mechanism 106, and operative connections 104 and 105 from the counter 99 to a conventional track switch point mechanism 107.

The reading of the counter 99 is 007 because seven empty cans 57 stand ready to be picked up. Whenever, for example, the counter 99 reads 003, the counter 99 sets the track switching mechanism 107 via the operative connection 104 to travel on the circular or oval track, so that an oncoming transport device which, in the illustrated embodiment thereof, carries three filled cans, can perform the can exchange. The instant the transport device 22 crosses or travels past the switch mechanism 107, a resetting pulse is transmitted via the operative connection 105 to the counter 99 with the result that three units are deducted from the counter reading in accordance with the number of the cans exchangeable in an exchange operation. Simultaneously, the track switch mechanism 107 is reset automatically. A second transport device can then no longer perform the same circular or oval trip, no more than the actually active transport device can circle around the same spinning machine a second time. When the active transport device 22 returns from the circular or oval course to the rectilinear course, as clearly shown in FIG. 4, the switch mechanism 107 is reset automatically to the setting predetermined by the counter 99 so that, for the case in which three or more empty cans stand ready to be exchanged, another transport device can embark on the circular or oval trip.

According to FIG. 4, the transport device is, in fact, operative at the spinning machine 2. Although, five empty cans 57 stand ready thereat, the counter 98 only indicates or displays the reading 002, because the transport device has, in fact, crossed or travelled past the switch mechanism 106, which had previously been set for circular or oval travel by the operative connection 102. When the crossing had occurred, a restorating pulse was sent via the operative connection 103 to the counter 98 which had then deducted three units from the counter reading 005.

When the transport device 22 has delivered the three full cans thereof and has picked up empty cans in place thereof, the switch mechanism 106, after the transport device 22 has again left the spinning machine 1, is not reset for travel over the circular or oval course because the counter reading has not yet reached the value 003.

The transport device 22 remains standing at the machine 1 in front of each section so as to determine if an exchange of cans is necessary and in order, then, to deliver a filled can and/or pick-up or remove an empty can.

In FIG. 4, there is shown with respect to the spinning machine 2 that the exchange of cans can also be accomplished differently. The sensors can determine, namely alternatively during the travel, where empty set locations 56 are located and where empty cans 57 are standing. If, alternatively, the travel path measuring device 81 does not cooperate with the sensor 78, but rather with the sensors 71, 72 and 73, 74, the transport device 22 can always be driven into a position desirable for unloading and loading, respectivel. The transport device 22 will, for example at the spinning machine 2, first deposit a full can, then pick up an empty can, travel past the next empty can and deposit the second full can, travel back to pick up the second empty can, then travel past both further cans in order to deposit the last full can, and then return to the empty can identified by reference numeral 57 in order to pick up this can. Thereafter, the transport device would circle the spinning machine 2 without any further pause or delay, and leave it. Thereafter, the switch point mechanism 107 would be set again for circular or oval travel because the counter 99 would be set back from 007 to 004, i.e. because sufficient cans stand ready yet to be exchanged. The section sensor 78 which is connected via the operative connection 95 and 97 and via the travel path measuring device 81 to the switching device 70 and, consequently, also to the remaining sensors, frees both the loading device 36 as well as the loading device 50 at each section only for a single loading and unloading operation, respectively. For this reason, the sections cannot be occupied too densely with cans which are in reserve, if this is not desired. The foregoing is a description corresponding in substance to German Application P 35 05 495.6, dated Feb. 16, 1985, the International priority of which is being claimed for the instant application, and which is hereby made part of this application. Any material discrepancies between the foregoing specification and the aforementioned corresponding German application are to be resolved in favor of the latter.

I claim:

1. Device for exchanging empty cans with cans filled with sliver at a machine for processing the sliver having set locations for the cans, comprising a mobile transport device automatically drivable along a floorlike travel path at the machine, said mobile transport device having a loading device for empty cans and an unloading device for filled cans, the sliver-processing machine being subdivided into sections, the set locations for the cans being at respective specific locations of said sections, said transport device having at least one sensor for recognizing the presence of a can disposed at one of the set locations, and at least another sensor for recognizing the presence of sliver filling said last-mentioned can, said loading device being controllable by said sensors, respectively, for recognizing the presence of an empty can at a respective set location, and said unloading device being also controllable by said sensors, respectively, for recognizing the absence of a can at a respective set location, said transport device also having at least one sensor for recognizing the sections of the sliver-processing machine; drive means for said mobile transport device; and means for operatively connecting said sensors to said drive means and controlling said drive means in response to at least one of said sensors for performing at least one of the functions consisting of recognizing the presence of empty cans and the absence of cans at the respective set locations and recognizing respective sections and boundaries of said sections.

2. Device according to claim 1 wherein said mobile transport device has at least one sensor for detecting an obstruction located on the travel path of said transport device.

3. Device according to claim 1 wherein said drive means has a travelling-gear motor, and a travel-path measuring device located on said mobile transport device and cooperatively connected to said travelling-gear motor.

4. Device according to claim 1 including a travel-path measuring device located on said mobile transport device and cooperatively connected to said additional sensors for recognizing said sections or section boundaries of the sliver-processing machine.

5. Device according to claim 1 including a travel-path measuring device located on said mobile transport device and cooperatively connected to said loading device.

* * * * *